US007780317B2

(12) United States Patent
Schroll et al.

(10) Patent No.: US 7,780,317 B2
(45) Date of Patent: Aug. 24, 2010

(54) LED ILLUMINATION SYSTEM

(75) Inventors: Katrin Schroll, Matzing (DE); Allessandro Scordino, Mestre (IT)

(73) Assignee: Osram Gesellschaft mit beschrankter Haftung, Munich (DE)

( * ) Notice: Subject to any disclaimer, the term of this patent is extended or adjusted under 35 U.S.C. 154(b) by 0 days.

(21) Appl. No.: 11/986,806

(22) Filed: Nov. 26, 2007

(65) Prior Publication Data

US 2008/0123331 A1 May 29, 2008

(30) Foreign Application Priority Data

Nov. 24, 2006 (EP) ..... 06024400

(51) Int. Cl.
*F21V 5/04* (2006.01)

(52) U.S. Cl. ..... 362/309; 362/308; 362/328

(58) Field of Classification Search ..... 362/231, 362/235, 307, 308, 309, 327–329, 800, 268
See application file for complete search history.

(56) References Cited

U.S. PATENT DOCUMENTS 5,683,175 A * 11/1997 Golz ..... 362/338
6,066,861 A 5/2000 Hohn et al.
6,086,227 A * 7/2000 O'Connell et al. ..... 362/297
6,953,264 B2 * 10/2005 Ter-Hovhannisian ..... 362/241
7,196,460 B2 * 3/2007 Kling ..... 313/113
7,572,036 B2 * 8/2009 Yoon et al. ..... 362/331
2004/0264185 A1 12/2004 Grotsch et al.
2006/0027828 A1 2/2006 Kikuchi
2007/0268694 A1 * 11/2007 Bailey et al. ..... 362/231

FOREIGN PATENT DOCUMENTS

| | | |
|---|---|---|
| DE | 10 2005 059 362 | 9/2006 |
| EP | 1 533 774 | 6/2004 |
| WO | WO 98/12757 | 3/1998 |
| WO | WO 2005/022030 | 3/2005 |
| WO | WO 2006/072398 | 7/2006 |

OTHER PUBLICATIONS

P. Schreiber et al., "Homogeneous LED-illumination using microlens arrays", Nonimaging Optics and Efficient Illumination Systems II, vol. 5924, pp. K1-K9, Aug. 20, 2005.

* cited by examiner

*Primary Examiner*—Thomas M Sember
(74) *Attorney, Agent, or Firm*—Cohen Pontani Lieberman & Pavane LLP

(57) ABSTRACT

An LED illumination system comprising an LED light source (3) which emits light (8) in a main direction (9) and a first optical element (1), a second optical element (2) is arranged downstream of the first optical element (1) in the main direction (9), and the second optical element (2) has on a light entrance surface (6) which faces the LED light source (3) a surface structure (4) that comprises a plurality of pillow-shaped prominences (5).

19 Claims, 3 Drawing Sheets

LED ILLUMINATION SYSTEM

RELATED APPLICATIONS

This patent application claims the priority of European patent application 06024400.1 filed Nov. 24, 2006, the disclosure content of which is hereby incorporated by reference.

FIELD OF THE INVENTION

The invention relates to an LED illumination system, in particular to an LED illumination system which emits white light.

BACKGROUND OF THE INVENTION

LED light sources are characterized by a high efficiency, a long lifetime and a comparatively low sensitivity against shocks and vibrations. Therefore, LED light sources can be used in illumination systems in which incandescent lamps have often been used so far, in particular in lamps for general lighting or in car headlights. Due to their high brightness, LED light sources are also suited for use in traffic lamps or in light sources for projection systems.

LED light sources are often used in combination with one or more optical elements which reduce the divergence of the emitted light. For example, the document US 2004/0264185 A1 describes an LED light source that contains an optical concentrator to reduce the divergence of the emitted light.

The document WO 98/12757 A1 describes a method to produce white light by luminescence conversion. In this case, the LED contains at least one LED chip which emits blue and/or ultraviolet light. The emitted blue and/or ultraviolet light passes through a layer which contains luminescence conversion particles that convert at least a part of the emitted light to a complementary color with a longer wavelength, for example to yellow light. The blue and/or ultraviolet light and the yellow light intermix to white light.

Another known method to produce white light with LED chips is color mixing. In this case, the light emitted by a plurality of LED chips with different colors, for example red, green and blue light, is intermixed to produce white light. Both methods to produce white light by luminescence conversion or by color mixing are based on the intermixing of light with at least two different wavelengths. In LED illumination devices which use one of these methods to produce white light the problem may occur that the intermixing of different colors to white light is not perfect. In this case, the light distribution does not show homogenous white light but unwanted colors in at least some directions in which light is emitted. This problem particularly occurs when an optical element, e.g. a primary lens or an optical concentrator, is used in combination with the LED light source.

SUMMARY OF THE INVENTION

It is an object of the present invention to provide an improved LED illumination system, in particular an LED illumination system which provides an improved color mixing to produce a homogenous light distribution, preferably of totally white color.

This and other objects are attained in accordance with one aspect of the invention directed to an LED illumination system that comprises an LED light source which emits light in a main direction and a first optical element, and a second optical element which is arranged downstream of the first optical element in the main direction. The second optical element has on a light entrance surface which faces the LED light source a surface structure that comprises a plurality of pillow-shaped prominences.

The pillow-shaped prominences which are arranged on the light entrance surface of the second optical element advantageously diffuse the light emitted by the LED light source after it has passed the first optical element. In this way, the pillow-shaped surface structure improves the color mixing of the light that is emitted by the LED light source.

Preferably, the second optical element has a convex curvature on the light exit surface which is opposite of the pillow-shaped surface structure. In this way, the light entrance surface of the second optical element diffuses the incoming light, whereas the light exit surface of the second optical element collimates the light beam.

The pillow-shaped prominences preferably have a polygonal base area. In particular, the polygonal base area can be a hexagonal or an octagonal base area. In this way, it can be achieved that the base areas of the pillow-shaped prominences cover the complete light entrance surface of the second optical element. This is in particular advantageous in comparison to prominences with a circular or elliptical base area because in this case there would be regions between the prominences which have flat surfaces.

The lateral size of the pillow-shaped prominences is advantageously between 200 μm and 5 mm.

The surfaces of the pillow-shaped prominences preferably have a convex curvature. In particular, the convex curvature can be an elliptical curvature. The height of the pillow-shaped prominences is advantageously 200 μm or more. In a particularly preferred embodiment the height of the pillow-shaped prominences is 500 μm or more. In this case, multiple reflections of the light beams advantageously occur inside the pillow-shaped prominences. Preferably, the number of internal reflections of a light beam inside the pillow-shaped prominences is between 10 and 20.

In a preferred embodiment of the invention a distance between a light exit surface of the first optical element and the light entrance surface of the second optical element is 2000 μm or less. In particular, the distance between the light exit surface of the first optical element and the light entrance surface of the second optical element can be between 50 μm and 1500 μm.

In a preferred embodiment of the invention, the LED light source emits white light. However, the invention is not restricted to white light sources. In particular, the invention can also advantageously be used to improve the color mixing of the colors of a plurality of LED chips to a combination color.

The LED light source comprises in a preferred embodiment at least one LED chip which emits ultraviolet and/or blue light. In this case, the LED illumination system advantageously comprises a luminescence conversion layer. The luminescence conversion layer might be arranged between the LED light source and the first optical element. For example, the luminescence conversion layer can be deposited on the at least one LED chip or on the light entrance surface of the first optical element. Alternatively, luminescence conversion particles can also be distributed in the first optical element. For example, the first optical element can be made of a polymer and the luminescence conversion particles can be embedded in the polymer.

With the luminescence conversion layer, at least a part of the light that is emitted by the LED chips is converted to longer wavelengths, in particular to a complementary color. The complementary colors are preferably mixed to white light. For example, blue light which is emitted from the LED chips and yellow light which is produced by the luminescence conversion particles are mixed to produce white light.

In another preferred embodiment the LED light source comprises at least one red, one green and one blue LED chip to produce white light by color mixing.

In both cases of white light production by luminescence conversion and color mixing, the mixing of the different wavelengths is improved by the pillow-shaped surface structure on the light entrance surface of the second optical element.

In a preferred embodiment of the invention, the LED light source comprises a plurality of LED chips. For example, the LED light source can comprise a plurality of blue light emitting LED chips which emit light that is converted to white light.

In another preferred embodiment the first optical element is an optical concentrator. In particular, the optical concentrator may be a compound parabolic concentrator (CPC). The optical concentrator advantageously reduces the divergence of the light that is emitted by the LED source.

DETAILED DESCRIPTION OF THE DRAWINGS

Identical or identically acting elements are provided with the same reference symbols in the Figures.

Figure 1:
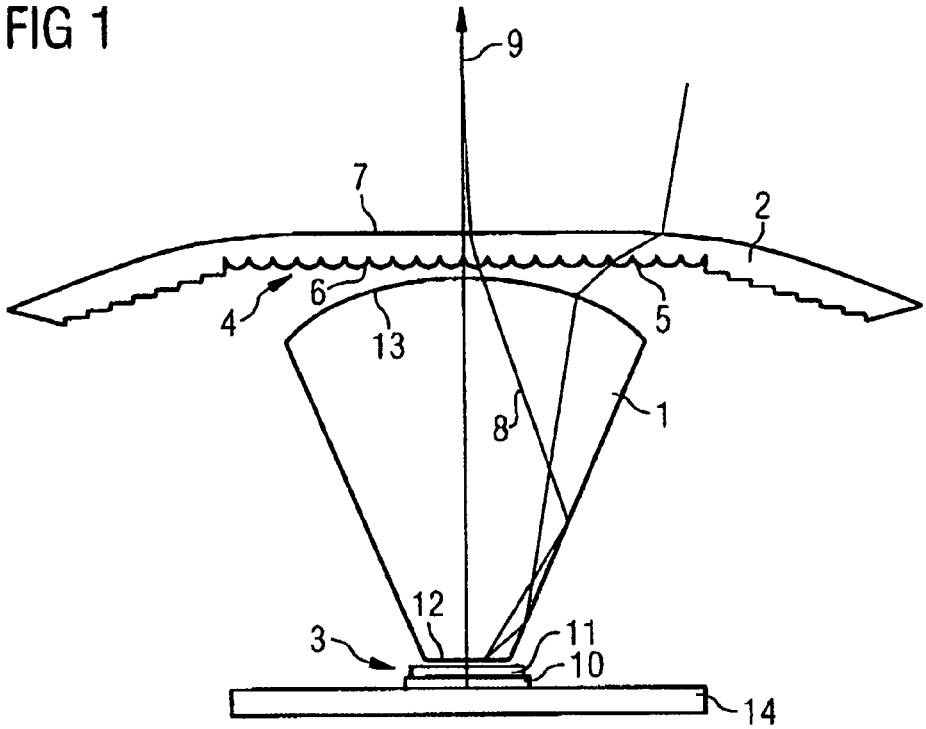
FIG. 1 diagrammatically shows a cross-section through an LED illumination system according to a first embodiment of the invention, FIG. 2 diagrammatically shows a top view and a bottom view of the second optical element according to an embodiment of the invention, FIG. 3 diagrammatically shows an enlarged view of the second optical element which is shown in FIG. 2, FIG. 4 diagrammatically shows a further cross-section through the LED illumination system according to the first embodiment of the invention, FIG. 5 diagrammatically shows a simulated light distribution behind the first optical element, and FIG. 6 diagrammatically shows a simulated light distribution behind the second optical element.

The first embodiment of the invention which is shown in FIG. 1 comprises an LED light source 3 which emits light 8 in a main direction 9, a first optical element 1 and a second optical element 2 which is arranged downstream of the first optical element 1 in the main direction 9.

The LED light source 3 comprises at least one LED chip which may be arranged on a carrier 14. Preferably, the LED chip 10 is an LED chip which emits blue or ultraviolet light. In this case, a luminescence conversion layer 11 is preferably arranged on the surface of the LED chip 10. The luminescence conversion layer 11 contains luminescence conversion particles which are able to convert the emitted blue or ultraviolet light 8 to longer wavelengths, in particular to a complementary color, e.g. yellow. Luminescence conversion particles which can be used are described for example in the document WO 98/12757 A1, the disclosure content of which is hereby incorporated by reference. The mixing of the emitted ultraviolet or blue light with the converted light, for example yellow light, results in white light.

The luminescence conversion layer 11 is not necessarily placed on the top surface of the LED chip 10. Alternatively, the luminescence conversion layer 11 may be placed on a light entrance surface 12 or a light exit surface 13 of the first optical element 1. It is also possible that luminescence conversion particles are arranged inside the volume of the first optical element 1. For example, the first optical element 1 is made of a polymer, in particular polycarbonate, and the luminescence conversion particles may be embedded in the polymer.

Instead of one or more blue or ultraviolet light-emitting LED chips 10 the LED light source 3 may also comprise at least one red, one green and one blue LED chip to produce white light by color mixing. In this case, a luminescence conversion layer 11 is not necessary for the production of white light.

The first optical element 1 is preferably used to reduce the beam divergence of the light 8 that is emitted by the LED chip 10. In particular, the first optical element 1 can be an optical concentrator. The light that is emitted by the LED chip 10 enters the optical concentrator at a light entrance surface 12 which is preferably arranged close to the light exit surface of the LED chip 10. Light beams which are emitted under comparatively large angles with respect to the main direction 9 are reflected at the side surfaces of the optical concentrator 1 and are in this way directed to the light exit surface 13 of the optical concentrator 1.

The first optical element 1 reduces the beam divergence of the emitted light 8. However, the color mixing may not be perfect behind the first optical element 1. This means that there may be a local variation of the color of the emitted light after it has passed the optical concentrator. In particular, the coordinates of the light in a CIE diagram can vary in a plane above the light exit surface 13 of the optical concentrator 1.

To improve the color mixing the LED illumination system comprises a second optical element 2. The refractive index of the second optical element is preferably in a range between 1 and 1.8. In particular, the material of the second optical element 2 can be a polymer. In this case, the second optical element 2 can be produced by injection moulding with low effort.

The second optical element 2 has a surface structure 4 on a light entrance surface 6 which faces the LED light source 3. The surface structure 4 comprises a plurality of pillow-shaped prominences 5. The pillow-shaped prominences 5 preferably have a polygonal base area and a convex curved surface. For example, the convex-shaped surface of the prominences 5 may have an ellipsoidal or a spherical curvature. Alternatively, the pillow-shaped prominences 5 may also have a pyramidal structure. The optimum curvature of the pillow-shaped prominences 5 depends on the desired collimation angle. It can be found out by an optical simulation of the light distribution behind the first and second optical element.

Figure 2:
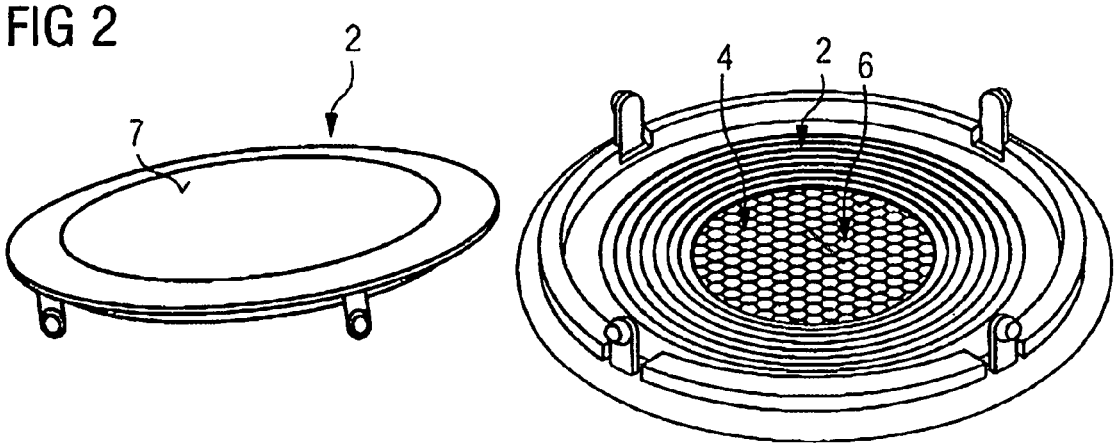

A second optical element 2 according to an embodiment of the invention is shown in FIG. 2 in a perspective top view (left side) and in a perspective bottom view (right side). The light exit surface 7 on the top side of the second optical element 2 has a convex curvature to collimate the light beam. The light entrance surface 6 which is arranged on the bottom side of the second optical element 2 has a surface structure 4 that comprises a plurality of pillow-shaped prominences 5.

Figure 3:
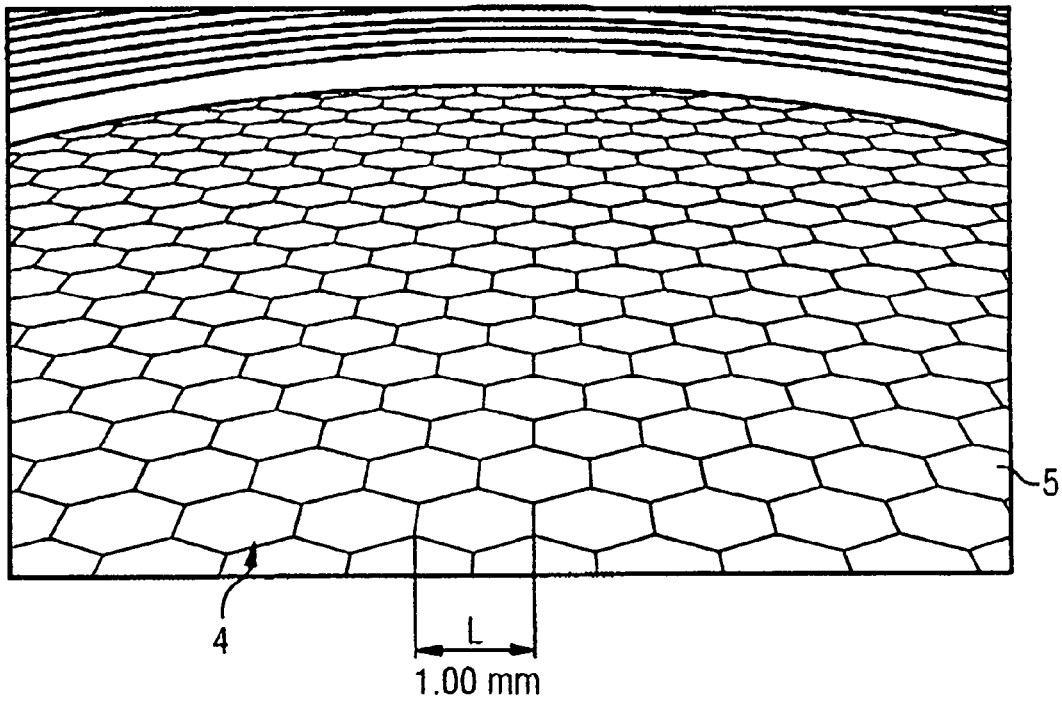

The surface structure 4 with the pillow-shaped prominences 5 is shown in more detail in FIG. 3 which shows an enlarged area of the second optical element 2. The pillow-shaped prominences 5 have hexagonal base areas. Alternatively, the pillow-shaped prominences 5 may also have octagonal or another type of a polygonal base areas.

The lateral size L of the pillow-shaped prominences 5 is preferably between 200 μm and 5 mm. In the embodiment shown in FIG. 3 the lateral size L of the pillow-shaped prominences is 1.00 mm.

Figure 4:
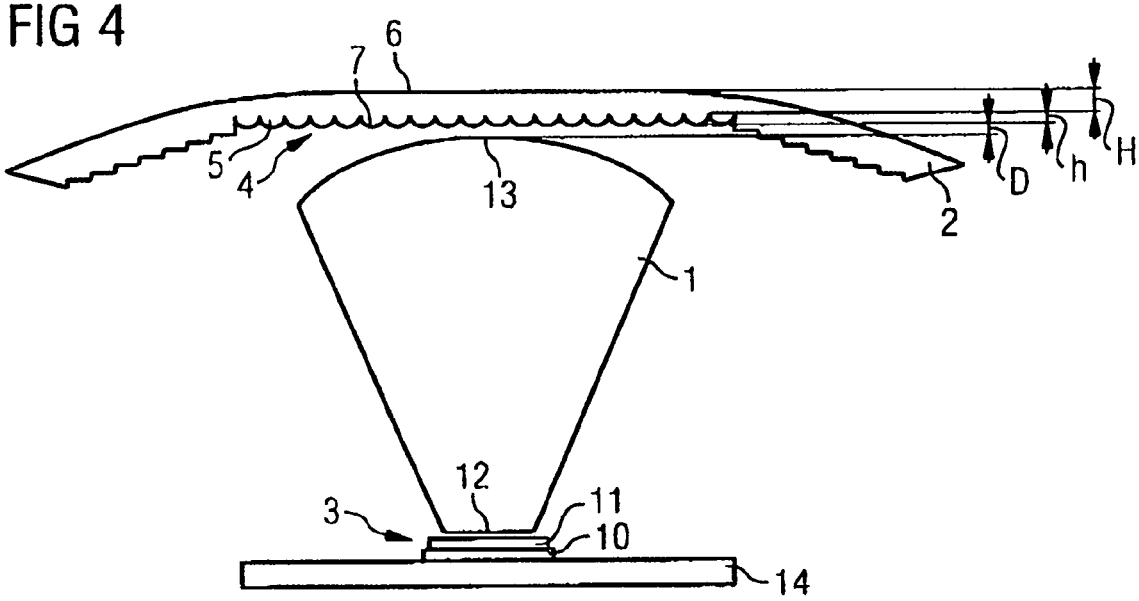

The height h of the pillow-shaped prominences 5 which is indicated in FIG. 4 is preferably 200 μm or more. It is desirable that multiple internal reflections of the light beams occur in the second optical element. To obtain between 10 and 20 reflections inside the surface structure 4, a height of at least 500 μm is preferred for the pillow-shaped prominences 5.

A surface structure 4 with a lateral pillow sizes of 1 mm, as shown in FIG. 3, is a good choice for a light source with a comparatively narrow beam. In this case, the height h of the pillow-shaped prominences 5 should be at least between 200 μm and 500 μm to obtain a good color mixing.

For a light source with a broad beam, in particular for a light source with a Lambertian radiation pattern, the lateral dimensions L of the pillow-shaped prominences 5 should be about 2 mm.

The optimum size of the pillow-shaped prominences 5 is related to the shape of the incoming beam at the light entrance surface 6. Furthermore, the size and the shape of the pillows is related to the amount of wavelength separation that is caused by the distribution of luminescence conversion material on the LED or by the distance between the LED chips which produce white light by color mixing. It has been found out that an as-small-as-possible surface structure 4 of pillow-shaped prominences 5 improves the wavelengths mixing and reduces in this way the effect of wavelengths separation due to the primary lens of the LED illumination system.

The distance D between the light source 3 and the pillow-shaped surface structure 4 should be small to achieve a good wavelength mixing. Preferably, the distance between the first optical element 1 and the surface structure 4 of the second optical element 2 is 2000 μm or less. In particular, the distance D can be in the range between 50 μm and 1500 μm.

The second optical element can be advantageously comparatively thin. In particular, the overall height H of the second optical element 2 is in the range between 500 μm and 2500 μm. In a preferred embodiment, the overall height of the second optical element 2 is about 600 μm. In this case, the second optical element 2 has a high value of transmittance, for example in the range of 90%.

Figure 5:
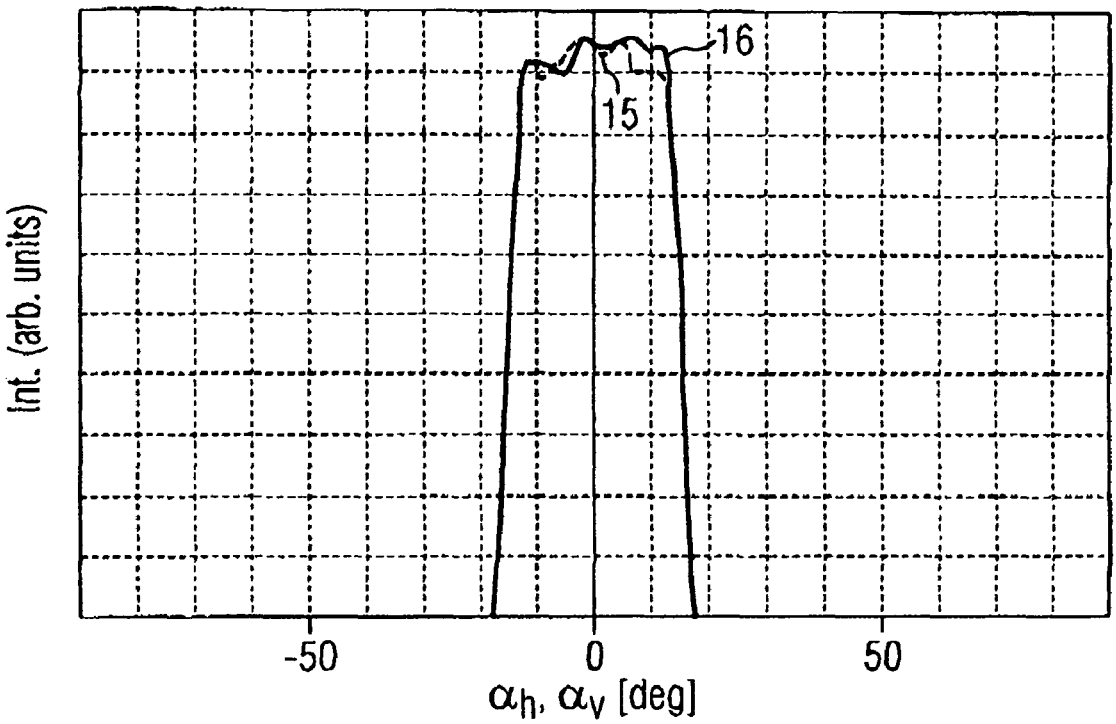
Figure 6:
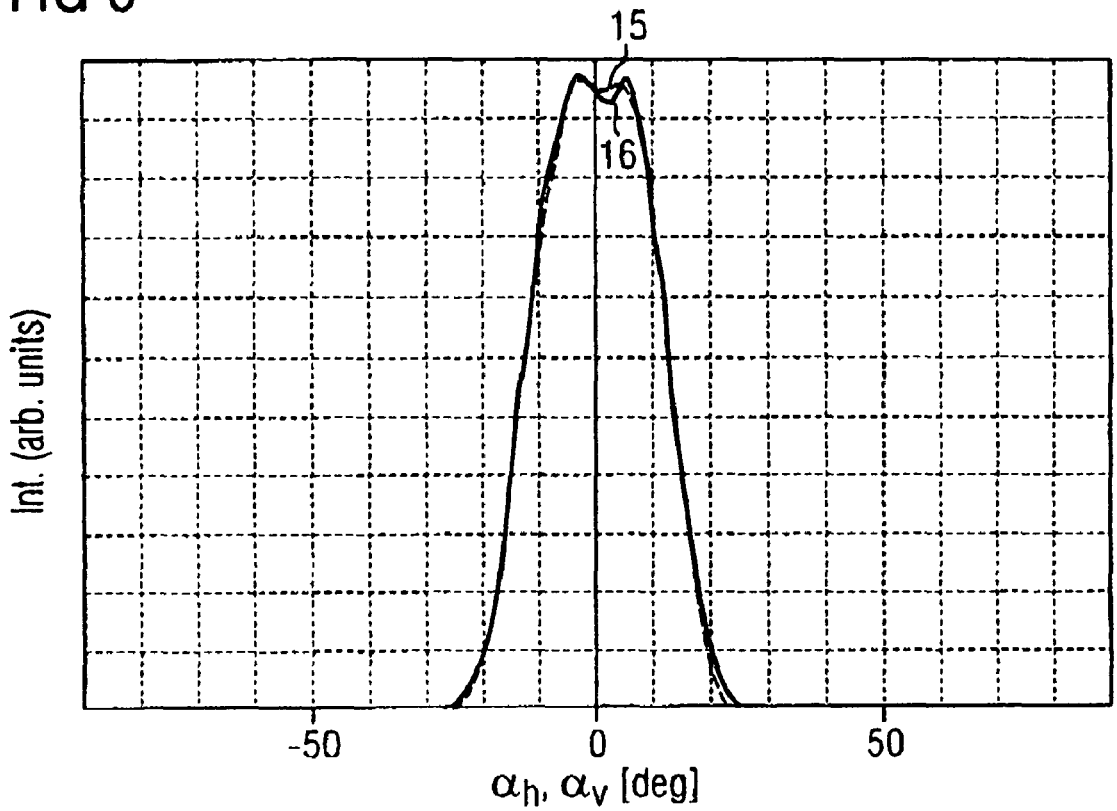

A simulation of the light distribution behind the first optical element 1, as seen in the main direction, is presented in FIG. 5 and a simulated light distribution behind the second optical element 2 is shown in FIG. 6. In both cases, the light intensity in arbitrary units is calculated as a function of the vertical angle $\alpha_v$ (curve 15) and the horizontal angle $\alpha_h$ (curve 16) with respect to the main direction 9. It has been found out that the light distribution behind the second optical element 2 is a homogenous distribution with totally white color. The beam divergence behind the second optical element 2 (FIG. 6) is advantageously reduced in comparison to the beam divergence behind the first optical element (FIG. 5). This results in a light distribution with a more narrow peak which is mainly due to the convex curvature of the light exit surface 7.

The second optical element 2 with the surface structure 4 that comprises a plurality of pillow-shaped prominences 5 can advantageously be used in combination with any kind of primary lens that is used in combination with an LED light source when the optical wavelength separation is visible in the color coordinates in a CIE diagram.

The scope of protection of the invention is not limited to the examples given hereinabove. The invention is embodied in each novel characteristic and each combination of characteristics, which particularly includes every combination of any features which are stated in the claims, even if this feature or this combination of features is not explicitly stated in the claims or in the examples.

We claim:

1. An LED illumination system comprising:

an LED light source which emits light in a main direction, a first optical element having a light exit surface, and a second optical element arranged downstream of the first optical element in the main direction, wherein the second optical element has, on a light entrance surface which faces the LED light source, a surface structure that comprises a plurality of pillow-shaped prominences, wherein the second optical element has a light exit surface with a convex curvature;

wherein a distance D between the light exit surface of the first optical element and the light entrance surface of the second optical element is 2000 μm or less, and wherein the pillow-shaped prominences have a polygonal base area.

2. The LED illumination system according to claim 1, wherein the polygonal base area is a hexagonal or an octagonal base area.

3. The LED illumination system according to claim 1, wherein a lateral size L of the pillow-shaped prominences is between 200 μm and 5 mm.

4. The LED illumination system according to claim 1, wherein the surfaces of the pillow-shaped prominences have a convex curvature.

5. The LED illumination system according to claim 4, wherein the convex curvature is an elliptical curvature.

6. The LED illumination system according to claim 1, wherein a height h of the pillow-shaped prominences is 200 μm or more.

7. The LED illumination system according to claim 1, wherein the distance D is between 50 μm and 1500 μm.

8. The LED illumination system according to claim 1, wherein the LED light source emits white light.

9. The LED illumination system according to claim 1, wherein the LED light source comprises at least one LED chip which emits ultraviolet and/or blue light.

10. The LED illumination system according to claim 1, further comprising a luminescence conversion layer.

11. The LED illumination system according to claim 1, wherein the LED light source comprises at least one red, one green and one blue LED chip to produce white light by color mixing.

12. The LED illumination system according claim 1, wherein the LED light source comprises a plurality of LED chips.

13. The LED illumination system according to claim 1, wherein the first optical element is an optical concentrator.

14. The LED illumination system according to claim 13, wherein the optical concentrator is a compound parabolic concentrator.

15. The LED illumination system according to claim 1, wherein the second optical element comprises a material having a refractive index in a range between about 1 and 1.8.

16. The LED illumination system according to claim 1, wherein the second optical element has a height H in a range between about 500 μm and 2500 μm.

17. The LED illumination system according to claim 1, wherein the second optical element has a height H of about 600 μm.

18. The LED illumination system according to claim 1, further comprising a luminescence conversion layer arranged between the LED light source and the first optical element along the main direction.

19. The LED illumination system according to claim 1, wherein a height h of the pillow-shaped prominences is about 500 μm or more.

* * * * *